United States Patent [19]

Koike et al.

[11] Patent Number: 4,813,896

[45] Date of Patent: Mar. 21, 1989

[54] TRIM ANGLE CONTROL DEVICE FOR MARINE PROPULSION MOTORS

[75] Inventors: Takashi Koike; Michihiro Taguchi, Hamamatsu, both of Japan

[73] Assignee: Sanshin Kogyo Kabushiki Kaisha, Hamamatsu, Japan

[21] Appl. No.: 136,492

[22] Filed: Dec. 22, 1987

Related U.S. Application Data

[63] Continuation of Ser. No. 877,473, Jun. 23, 1986, abandoned.

[30] Foreign Application Priority Data

Jun. 24, 1985 [JP] Japan ..... 60-135924

[51] Int. Cl.[4] ..... B63H 5/12

[52] U.S. Cl. ..... 440/61; 440/1

[58] Field of Search ..... 440/1, 2, 53, 55, 56, 440/57, 61, 900

[56] References Cited

U.S. PATENT DOCUMENTS

| | | | |
|---|---|---|---|
| 3,834,345 | 9/1974 | Hager et al. | 307/309 |
| 4,005,674 | 2/1977 | Davis | 440/1 |
| 4,605,375 | 8/1986 | Ferguson | 440/1 |

FOREIGN PATENT DOCUMENTS

| | | | |
|---|---|---|---|
| 59-48293 | 3/1984 | Japan | 440/61 |

*Primary Examiner*—Sherman D. Basinger
*Assistant Examiner*—Edwin L. Swinehart
*Attorney, Agent, or Firm*—Ernest A. Beutler

[57] ABSTRACT

Several embodiments of semi-automatic trim controls for marine outboard drives wherein the operator may achieve trim up or trim down operation at his choice. In accordance with the various embodiments, an arrangement is provided for discontinuing operation of the power once a preset position is reached. In some embodiments, this preset position is a trim up position and in others, it is a trim down or in both directions.

21 Claims, 4 Drawing Sheets

TRIM ANGLE CONTROL DEVICE FOR MARINE PROPULSION MOTORS

This is a continuation application Ser. No. 877,473, filed June 23, 1986 now abandoned.

BACKGROUND OF THE INVENTION

This invention relates to a trim angle control device for marine propulsion motors and more particularly to an improved arrangement for controlling the trim position of a marine outboard drive.

It is well known to support a marine outboard drive (either an outboard motor or the outboard drive portion of an inboard/outboard unit) for pivotal movement about a horizontally extending tilt axis. This pivotal movement is employed for permitting the outboard drive to be tilted up out of the water when not in use or, alternatively, for adjustment of the trim position of the outboard drive during operation of the associated watercraft. It is also well known that the optimum trim angle of the outboard drive varies with the running condition of the watercraft. A wide variety of power units are employed for effecting the pivotal movement of the outboard drive to adjust its trim position during running. Many of these devices are purely manual and require the operator's attention to set the trim angle for the various running conditions. Other devices, which are completely automatic, have also been proposed. The manual devices have the disadvantage of requiring the operator's attention so as to set the trim angle and thus divert from his other duties. Automatic systems, on the other hand, tend to cause frequent hunting of the position of the outboard drive and will adjust its position to compensate for transitory conditions. As a result, these devices do not actually provide the optimum trim angle under all conditions, particularly during transition from one condition to another.

The automatic systems also have a further disadvantage. For example, there are many times when the desirable trim angle is independent of the actual running condition of the watercraft. For example, when traveling at slow speeds, the automatic systems generally cause the outboard drive to be tilted down. However, if the watercraft is being operated in shallow water at low speeds, such a tilted down condition of the outboard drive is not only unnecessary but may be dangerous. In addition, even in deep water, there may be times when the operator wishes to achieve a sudden tilting up of the outboard drive to avoid an object which may be floating in the water or only shallowly submerged.

It is, therefore, a principal object of this invention to provide a device for setting the trim angle of an outboard drive that is simple in operation and which does not require great attention from the operator.

It is a further object of this invention to provide a trim angle control device for a marine propulsion unit that is semi-automatic in operation so that the operator may select a preset trim condition but can easily override this condition or make other settings of the outboard drive as he chooses.

SUMMARY OF THE INVENTION

This invention is adapted to be embodied in a trim control for a marine outboard drive that is supported for pivotal movement about a horizontally extending trim axis and which includes power means for adjusting the trim position of the outboard drive in a trim up direction and in a trim down direction. A controller is movable to a trim up position and a trim down position and control means operatively connect the controller to the power means for actuating the power means in a trim down direction when the controller is moved to its trim down position and in a trim up position when the controller is moved to its trim up position. The control means is effective to discontinue operation of the power means in at least one direction when the outboard drive reaches a preset position.

DETAILED DESCRIPTION OF THE PREFERRED EMBODIMENTS

Figure 1:
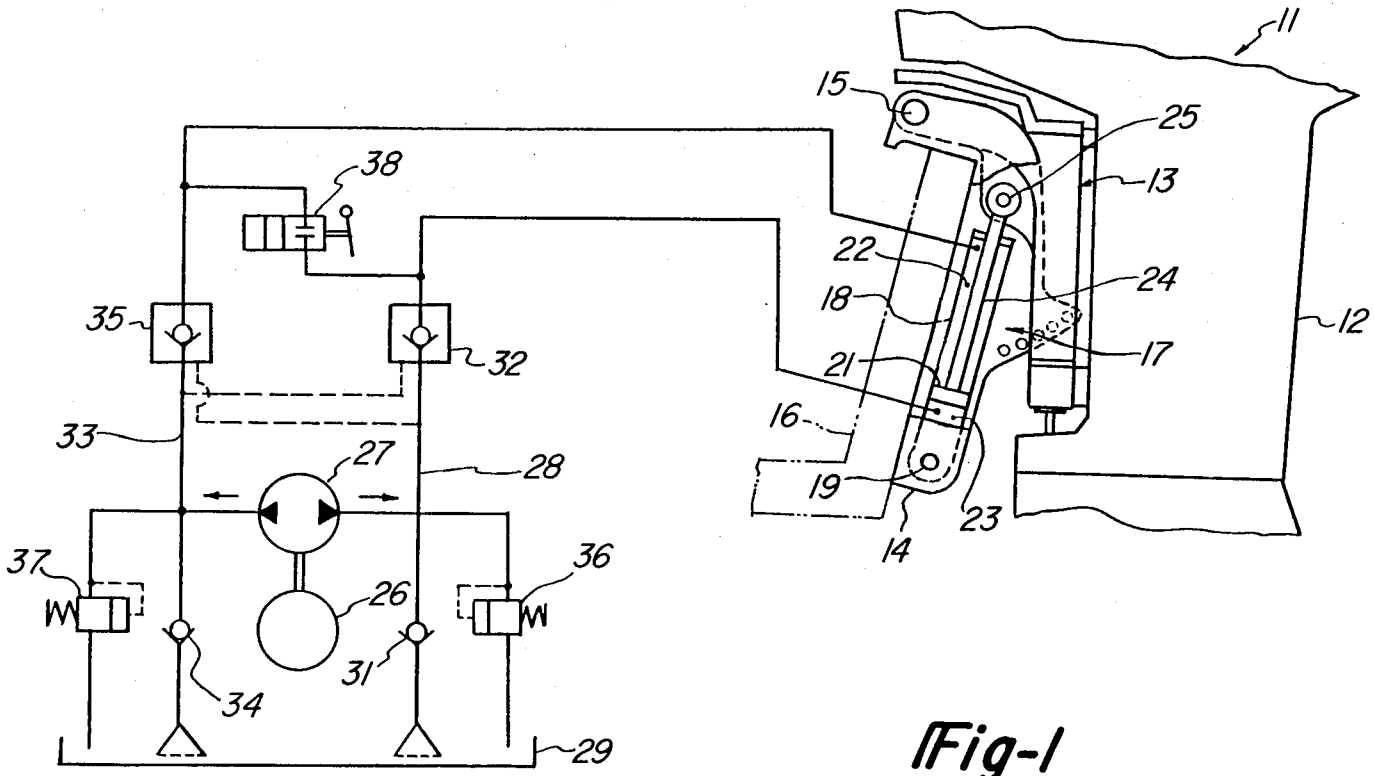
FIG. 1 is a partially schematic side elevational view of a marine outboard drive constructed in accordance with an embodiment of the invention.

Referring first to FIG. 1, an outboard motor constructed in accordance with an embodiment of the invention is identified generally by the reference numeral 11. Although the invention is described in conjunction with an outboard motor, it is to be understood that the invention may equally as well be practiced with the outboard drive unit of an inboard/outboard drive. For that reason, when the term "outboard drive" is used in the specification and claims, it is used generically to describe both types of construction.

The outboard drive includes a drive shaft housing 12 that carries, at its forward end, a steering shaft that is, in turn, journaled within a swivel bracket 13. The swivel bracket 13 is, in turn, affixed to a clamping bracket 14 by means of a tilt pin 15. The tilt pin 15 provides a pivotal connection between the clamping bracket 14 and the swivel bracket 13 for pivotal movement of the outboard drive 11 about a tilt axis defined by the tilt pin 15. The clamping bracket 14 is, in turn, adapted to be affixed to a transom 16 of an associated watercraft in a known manner.

The pivotal movement of the outboard drive 11 about the pivot pin 15 is controlled by means of a fluid motor, indicated generally by the reference numeral 17. The fluid motor 17 includes a cylinder assembly 18 which has a trunnion at its lower end that is pivotally connected by means of a pivot pin 19 to the clamping bracket 14. The cylinder 18 defines an internal bore in which a piston 21 is supported for reciprocation. The piston 21 divides this bore into an upper chamber 22 and a lower chamber 23. The piston 21 has affixed to it a piston rod 24 that is connected by means of a pivot pin 25 to the swivel bracket 13. Accordingly, extension of the piston 21 within the cylinder 18 will cause tilting movement of the outboard drive 11 about the pivot pin 15, as is well known in this art.

A hydraulic circuit, shown schematically in FIG. 1, is provided for pressurizing either the chambers 23 or 22 for effecting the tilting movement of the outboard drive 11. This circuit includes a reversible electric motor 26 that drives a reversible fluid pump 27. The pump 27 has a first port that communicates with a conduit 28 that extends from a reservoir 29 to the lower chamber 23 of the fluid motor. A check valve 31 is positioned in the conduit 28 between the reservoir 29 and the pump port. A pressure operated one-way valve 32 is positioned in the line 28 between the pump port and the fluid motor chamber 23.

In a similar manner, a further conduit 33 extends from the other pump port to the fluid chamber 22. A check valve 34 permits fluid to flow into the conduit 33 from the reservoir 29 and a pressure operated check valve 35 is positioned between this pump port and the chamber 22. A pair of pressure relief valves 36 and 37 are teed off of the lines 28 and 32 for pressure relief.

The hydraulic system operates as follows. If it is desired to tilt the outboard drive 11 up from the position shown in FIG. 1, the motor 26 is operated so that the pump 27 will be driven in a direction to pressurize the line 28 and the line 33 therefore acts as the return line. Fluid under pressure will flow through the line 28 and open the check valve 32 for flow into the chamber 23. At the same time, the check valve 35 will be opened in a known manner by the pressure existent in the line 28 and the line 33 thus acts as a return line so that fluid may be returned from the fluid motor chamber 22 to the inlet side of the pump 27 through the conduit 33. Makeup fluid may be drawn into the conduit 33 through the check valve 34 if required. When the piston 21 reaches the end of its stroke, the pressure will rise in the line 28 and this will be relieved through the relief valve 36 back to the reservoir 29.

It should be readily apparent that tilting down movement is achieved by rotating the motor 26 and pump 27 in the opposite direction so that the line 33 acts as the pressure line and the line 28 acts as the return line.

A manually operated valve 38 is provided between the lines 28 and 33 upstream of the pressure operated check valves 32 and 35. The valve 38 is movable between a closed position, wherein powered tilt and trim is afforded and an opened position wherein the operator may manually tilt the motor 11 up or down without resistance from the fluid system. The hydraulic system as thus far described is conventional and, for that reason, further details are not believed to be necessary. In fact, the invention may be utilized with a wide variety of hydraulic or electrical systems and, for that reason, further details of the hydraulic system are not believed to be necessary to enable those skilled in the art to practice the invention.

Figure 2:
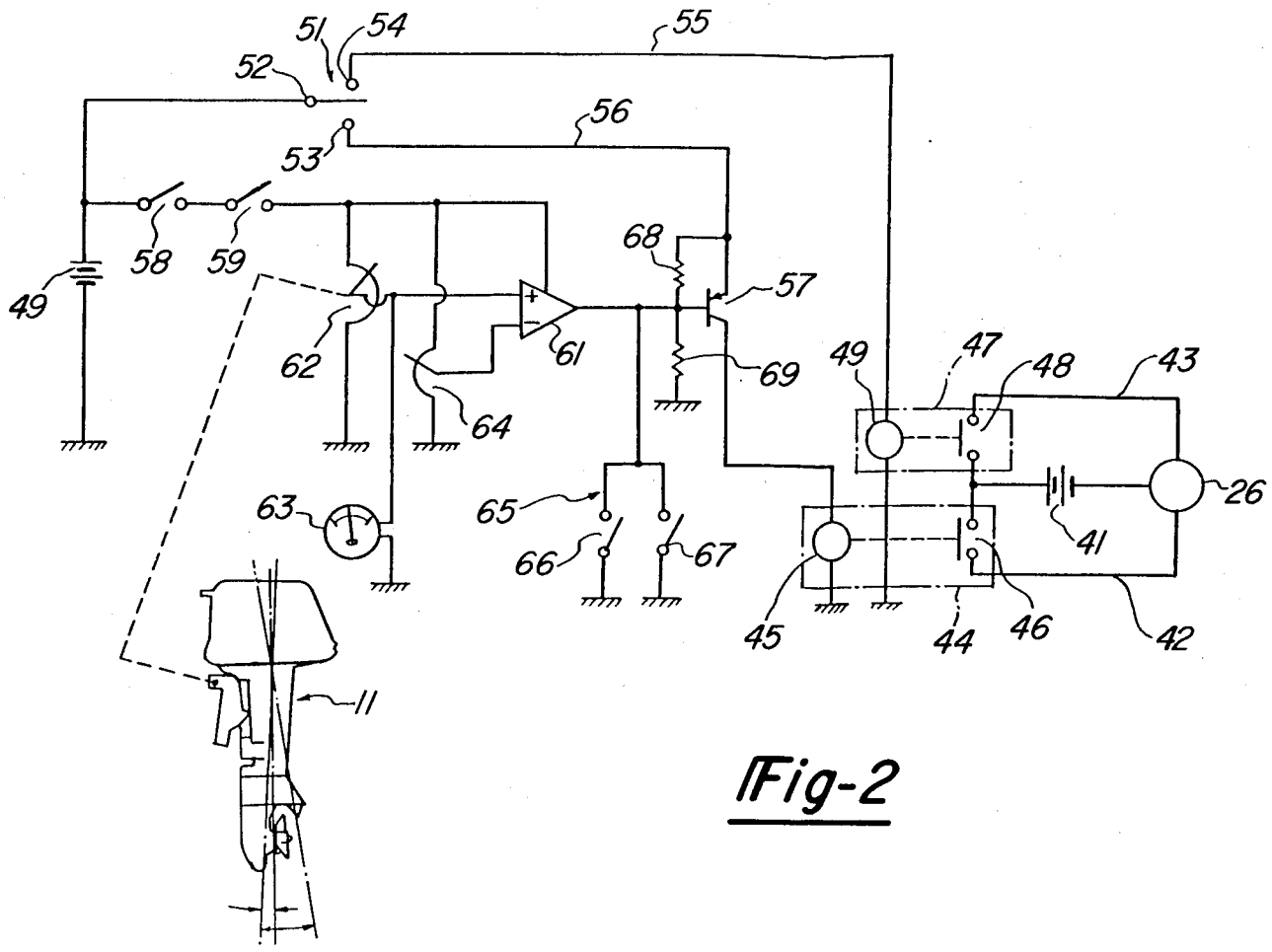
FIG. 2 is a schematic view showing a control circuit constructed in accordance with a first embodiment of the invention.

In accordance with the invention, an arrangement is provided for permitting the operator to selectively activate the motor 26 so as to drive the fluid motor 17 in a direction to adjust the tilt position of the outboard drive 11 between a first position and a second preset position. This mechanism automatically discontinues the operation of the electric motor 26 when this present position is reached and thus a semi-automatic operation is provided for the tilting of the outboard drive. FIG. 2 shows a first embodiment wherein the operator may selectively activate the outboard drive so as to effect a semi-automatic tilting up operation of the outboard drive. The outboard drive may be tilted down under operator control.

Referring now specifically to this figure, the electric motor 26 is shown as being in circuit with a battery 41. The circuit includes a tilt up circuit 42 and a tilt down circuit 43. Depending on which of the circuits 42 or 43 is energized, the motor 26 will be driven in a direction to effect either tilting up or tilting down of the outboard drive. The tilt up circuit 42 is operated by means of a relay or solenoid operated switch assembly 44 including a solenoid winding 45 and a normally open contact 46 which, when closed, energizes the circuit 42 for driving the motor 26 in the tilt up direction. In a similar manner, a tilt down relay or solenoid controlled switch 47 having a normally open contact 48 and a solenoid winding 49 is provided for selectively closing the circuit 43 and energizing the motor 26 in the tilt down direction.

The control circuit for operating the relay or solenoid operated switches 44 and 47 includes a DC power source 49 that is in circuit with an operator controlled selector switch 51 having a live terminal 52 and an "up" terminal 53 and "down" terminal 54. The selector switch 51 is normally opened. If the operator selects tilt down operation, the live terminal 52 is connected to the down terminal 54 so as to energize a line 55 and deliver electrical power to the solenoid or winding 49 of the relay 47 for closing the switch 48 and driving the motor 26 in a down direction.

The terminal 53 is in contact with a line 56 that connects the terminal 53 to the winding 45 of the relay 44. However, a transistor 57 is provided in this line so that the transistor 57 must be switched on before the winding 45 can be energized. The transistor 57 is controlled by means of a control circuit including a main power switch 58 and a mode selector switch 59, which are in series with each other. When closed, the switches 58 and 59 energize a comparator 61. The comparator 61 receives a first signal of trim angle of the outboard drive 11 through a trim angle sensing device 62, which may be a variable resistor. Such variable resistors or trim angle sensors are well known in the art and, for that reason, a detailed description of this device is not believed to be necessary. If desired, a trim angle indicator 63 may also be energized by the sensors 62 so as to give the operator an indication of actual trim position of the outboard drive.

The other input of the comparator 61 receives a signal from a trim angle setting device 64 which may be preset by the operator or at the factory to provide the desired trim angle for automatic operation. If the actual trim angle $\theta$ is less than the preset desired trim angle $\alpha$, the comparator 61 will switch the transistor 57 on until the preset angle is reached at which time the comparator 61 will switch the transistor 57 off. A voltage divider circuit comprised of a pair of resistors 68 and 69 are in the circuit for operating the transistor 57. Hence, when the operator is operating in a given condition and desires to trim up to the preset condition, he need merely switch the mode selector 59 to its on position and move the selector switch 51 to the up condition and the outboard drive 11 will be tilted up to the preset position without further attention of the operator.

An arrangement is also provided for permitting manual adjustment past the preset trim up condition of the device 64. In order to permit such trimming up, however, it is necessary that the outboard drive 11 be slowed down sufficiently as indicated by a slow down indicator 65. The slow down indicator includes a pair of switches 66 and 67 either of which, when closed, indicates that further tilting up is permissible. The switch 66 may be operated by throttle valve position so as to permit tilting up beyond the preset position when a very slow engine speed is reached such as when traveling at slow speeds through shallow water. The switch 67 may be responsive to the transmission of the outboard drive and will be closed when the transmission is in neutral so as to permit tilting up such as when the watercraft is to be put in storage.

Figure 3:
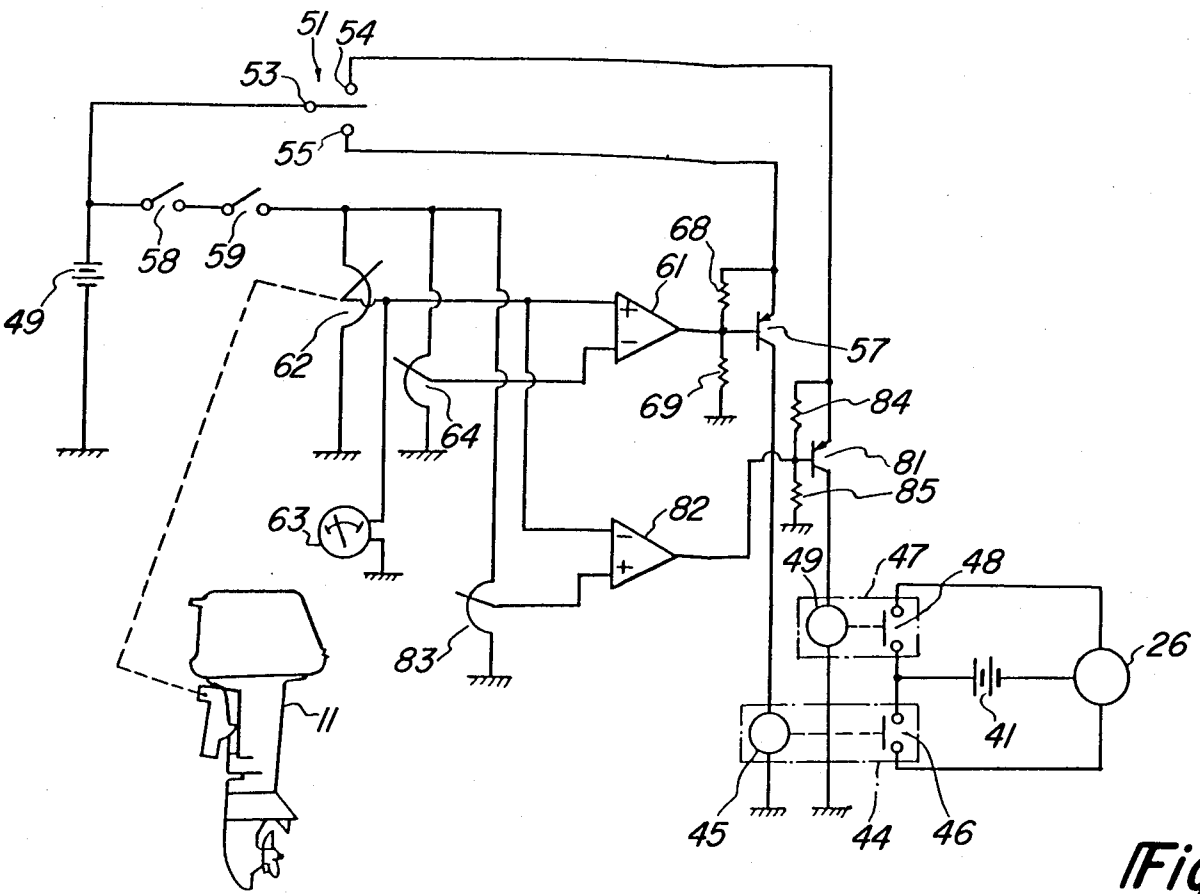
FIG. 3 is a schematic view, in part similar to FIG. 2, showing another embodiment.

In the embodiment of FIG. 2, the operator can select any trim down condition but automatic or semi-automatic tilt up control is limited by the trim up setter 64. FIG. 3 shows another embodiment of the invention wherein the preset trim up and trim down positions may both be set. The trim up setting device is the same as the embodiment of FIG. 2 and, for that reason, those components have been identified by the same reference numerals and will not be described again in detail.

In this embodiment, a transistor 81 is provided in the line from the down terminal 54 to the down relay winding 49. The gate of the transistor 81 is controlled by a comparator 82 to receive a trim angle indication from the trim angle sensor 62 and also which has an input from a trim down angle setter 83 which is preset to the desired trim down angle $\beta$ for switching the transistor 62 on when the trim down contact 54 is engaged and the outboard drive 11 is not trimmed down to the angle $\beta$. A voltage divider network made up of a pair of resistors 84 and 85 operate the transistor 81.

Figure 4:
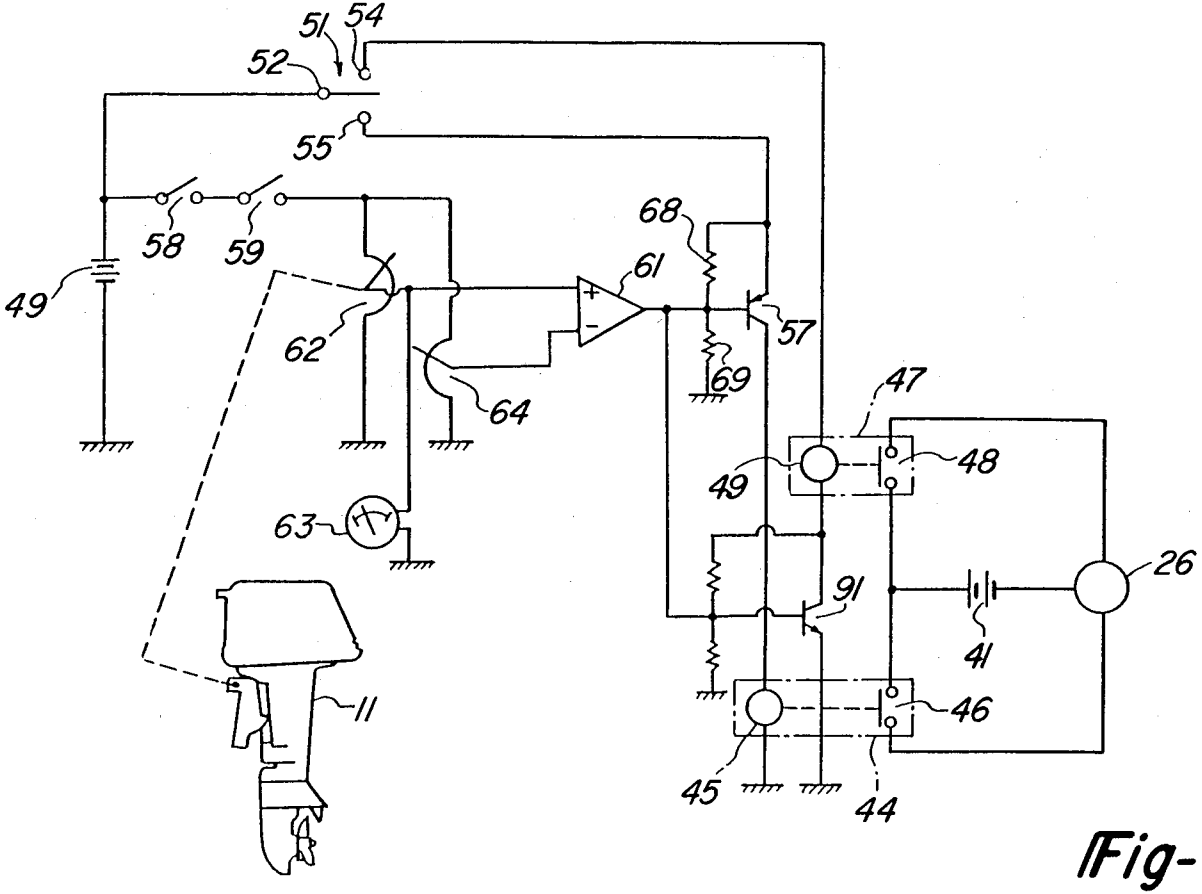
FIG. 4 is a schematic view, in part similar to FIGS. 2 and 3, and shows a still further embodiment.

FIG. 4 shows another embodiment of the invention wherein automatic trim up and trim down are controlled, however, in this embodiment both trim up and trim down positions are set the same by a single comparator 61 and setter 64. Automatic trim up is controlled by the trim up transistor 57 in the same manner as in the embodiments of FIGS. 2 and 3. In addition, a transistor 91 is provided in the trim down circuit and this transistor 91 is also controlled by the comparator 61 so that when the operator selects either semi-automatic trim up or trim down operation, the comparator 61 will operate either the relay 44 or 47 until the comparator 61 indicates that the desired trim angle has been set at which the time operation will be discontinued.

It should be readily apparent from the foregoing description that a number of embodiments of the invention have been illustrated and described each of which permits the operator to set one or both of the trim angle positions in a semi-automatic mode without requiring his full attention at all times nor without encountering the hunting which occurs with convention automatic systems. Although a number of embodiments of the invention have been illustrated and described, various changes and modifications may be made without departing from the spirit and scope of the invention, as defined by the appended claims.

We claim:

1. A trim control for a marine outboard drive supported for pivotal movement about a generally horizontally extending trim axis, power means for adjusting the trim position of said outboard drive in a trim up direction and in a trim down direction, a manually operable controller having a contact element movable to a trim up position for closing a trim up switch and a trim down position for closing a trim down switch, and control circuit means electrically connecting said controller to said power means for actuating said power means continuously in a trim up direction when said controller contact element is moved to its trim up position and closes said trim up switch and continuously in a trim down direction when said controller is moved to its trim down position and closes said trim down switch, said control means including operator selectively settable means other than said controller for discontinuing operation of said power means in at least one direction in response to said outboard drive reaching a preset position as determined by said operator selectively settable means.

2. A trim control as set forth in claim 1 wherein the control means is effective to discontinue operation of the power means in both directions when the outboard drive reaches preset positions.

3. A trim control as set forth in claim 2 wherein the preset positions are controlled by the same operator selectively settable means.

4. A trim control as set forth in claim 1 further including means for overriding the control means for permitting operator selected continued movement of the power means in the one direction.

5. A trim control as set forth in claim 4 wherein the override means is operable in response to an operating condition of the outboard drive.

6. A trim control as set forth in claim 5 wherein the operating condition comprises throttle position.

7. A trim control as set forth in claim 1 wherein the control means is effective to discontinue operation of the power means in a preset trim up position.

8. A trim control as set forth in claim 1 wherein the control means is effective to discontinue operation of the power means in a preset trim down position.

9. A trim control for a marine outboard drive supported for pivotal movement about a generally horizontally extending trim axis, power means for adjusting the trim position of said outboard drive in a trim up direction and in a trim down direction, a controller movable to a trim up position and a trim down position, and control means operatively connecting said controller to said power means for actuating said power means continuously in a trim up direction when said controller is moved to its trim up position and continuously in a trim down direction when said controller is moved to its trim down position, said control means including operator selectively settable means effective to discontinue operation of said power means in at least one direction when said outboard drive reaches a preset position as determined by said operator selectively settable means, and override means for permitting operated selected continued movement of said power means in said one direction in response to shifting of the transmission of the outboard drive to neutral.

10. A trim control for a marine outboard drive supported for pivotal movement about a generally horizontally extending trim axis, power means for adjusting the trim position of said outboard drive in a trim up direction and in a trim down direction, a controller movable to a trim up position and a trim down position, and control means operatively connecting said controller to said power means and having a first control state for actuating said power means in a trim up direction when said controller is moved to its trim up position and a second control state for actuating said power means in a trim down direction when said controller is moved to its trim down position, said control means being effective to discontinue operation of said power means in at least one direction and when in at least one of said states when said outboard drive reached a preset position, and override means for providing manual override to effect continued operator controlled movement of said outboard drive past said preset position in response to a sensed operating condition of said outboard drive and regardless of the state said controls means is in.

11. A trim control as set forth in claim 10 wherein the override means is operable in response to the speed of the outboard drive.

12. A trim control as set forth in claim 11 wherein the speed is sensed by sensing throttle position.

13. A trim control as set forth in claim 10 wherein the sensed operating condition comprises shifting of the transmission of the outboard drive to neutral.

14. A trim control as set forth in claim 10 wherein the preset position is selectively settable.

15. A trim control as set forth in claim 10 wherein the control means is effective to discontinue operation of the power means in both directions when the outboard drive reaches preset positions.

16. A trim control for a marine outboard drive supported for pivotal movement about a generally horizontally extending trim axis, power means for adjusting the trim position of said outboard drive in a trim up direction and in a trim down direction, a manually operable controller having a contact element movable to a trim up position for closing a trim up switch and a trim down position for closing a trim down switch, and a control circuit means electrically connecting said controller to said power means for actuating said power means in a trim up direction when said trim up switch is closed and in a trim down direction when said trim down switch is closed, said control means being effective to discontinue operation of said power means in only one direction when said outboard drive reaches a preset position and when the corresponding trim switch is closed, said control means being operative to effect operation of said power means in the other direction when the other trim switch is closed regardless of the position of said outboard drive means.

17. A trim control as set forth in claim 16 wherein the preset position is selectively settable.

18. A trim control as set forth in claim 16 further including means for overriding the control means for permitting operator selected continued movement of the power means in the one direction.

19. A trim control as set forth in claim 18 wherein the override means is operable in response to a running condition of the outboard drive.

20. A trim control as set forth in claim 19 wherein the running condition comprises throttle position.

21. A trim control as set forth in claim 19 wherein the running condition comprises shifting of the transmission of the outboard drive to neutral.

* * * * *